US011272753B2

(12) United States Patent
Murphy

(10) Patent No.: US 11,272,753 B2
(45) Date of Patent: Mar. 15, 2022

(54) HARDHAT WITH PROTECTED OVERHEAD COOLING FAN AND METHOD

(71) Applicant: Kevin Murphy, Beaver, PA (US)

(72) Inventor: Kevin Murphy, Beaver, PA (US)

( * ) Notice: Subject to any disclaimer, the term of this patent is extended or adjusted under 35 U.S.C. 154(b) by 0 days.

(21) Appl. No.: 16/940,166

(22) Filed: Jul. 27, 2020

(65) Prior Publication Data

US 2021/0289874 A1 Sep. 23, 2021

Related U.S. Application Data

(60) Provisional application No. 62/879,005, filed on Jul. 26, 2019.

(51) Int. Cl.

| | |
|---|---|
| ***A42B 3/28*** | (2006.01) |
| ***A42B 3/04*** | (2006.01) |
| ***F04D 25/06*** | (2006.01) |
| ***A42B 1/008*** | (2021.01) |
| ***A62B 18/04*** | (2006.01) |
| ***A42C 5/04*** | (2006.01) |
| ***F04D 29/58*** | (2006.01) |

(52) U.S. Cl.

CPC ..... *A42B 3/286* (2013.01); *A42B 1/008* (2013.01); *A42B 3/0406* (2013.01); *A42B 3/28* (2013.01); *A42B 3/283* (2013.01); *A42B 3/285* (2013.01); *A42C 5/04* (2013.01); *A62B 18/045* (2013.01); *F04D 25/0673* (2013.01); *F04D 29/5846* (2013.01); *Y10S 2/906* (2013.01)

(58) Field of Classification Search

CPC ..... A42B 3/286; A42B 3/285; A42B 3/283; A42B 3/28; A42B 1/008; A42B 3/0406; F04D 25/0673; Y10S 2/906; A42C 5/04; A62B 18/045

See application file for complete search history.

(56) References Cited

U.S. PATENT DOCUMENTS

| | | | | |
|---|---|---|---|---|
| 3,822,698 | A * | 7/1974 | Guy | A62B 18/045 128/201.25 |
| 5,113,853 | A * | 5/1992 | Dickey | A62B 18/045 128/200.28 |
| 5,283,914 | A * | 2/1994 | James | A42B 3/16 128/201.24 |
| 9,360,016 | B2 * | 6/2016 | Hamilton | F04D 27/004 |
| 2016/0255901 | A1 * | 9/2016 | Jeon | A42B 3/286 |
| 2016/0353827 | A1 * | 12/2016 | Verela | A42B 3/283 |

* cited by examiner

*Primary Examiner* — Peter J Bertheaud
(74) *Attorney, Agent, or Firm* — Gary P Topolosky

(57) ABSTRACT

A hardhat with a protected overhead cooling fan comprises: a main hardhat body component having an upper aperture through which air is drawn and pulled down into a battery powered cooling fan; a fan cover component spaced at least about ¼ inch from and permanently adhered to the main hardhat body with a plurality of linear ridges; a battery pack for the cooling fan; and a plurality of connecting wires. A method of use is also disclosed.

20 Claims, 7 Drawing Sheets

HARDHAT WITH PROTECTED OVERHEAD COOLING FAN AND METHOD

CROSS-REFERENCE TO RELATED APPLICATIONS

This application is a perfection of U.S. Provisional Ser. No. 62/879,005, filed on Jul. 26, 2019, the disclosure of which is fully incorporated herein.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

(1) Field of the Invention

This invention relates to construction and other working hardhats or protective headgear. More particularly, it relates to a hardhat having an overhead fan to cool its wearer's head, said fan being fully protected along with the wearer's head beneath. The fan is powered by a rechargeable battery pack.

(2) Description of Related Art Including Information Disclosed Under 37 CFR 1.97 and 1.98

Air-conditioned hardhats are desirable for cooling their wearer's heads. Workers are required to wear hardhats for safety reasons regardless of ambient temperature conditions. When the temperatures are high, hardhats can become quite uncomfortable and excessive perspiration can result. Under extreme conditions, a risk of heatstroke exists. Air-conditioned hardhats cool the wearer's head thereby increasing the wearer's comfort level and decreasing wearer perspiration.

Representative relevant art that this invention nevertheless distinguishes over, include but are not limited to, the disclosures in: Stein U.S. Pat. No. 5,715,533, Waters U.S. Pat. Nos. 4,893,356 and 3,548,415, Guzowski U.S. Pat. No. 4,309,774, Hirsch et al. U.S. Pat. No. 4,680,815, Katz U.S. Pat. No. 6,122,773, Pullin U.S. Design Pat. No. D275,334, Kohl U.S. Pat. No. 6,637,651, Maxwell U.S. Pat. No. 6,760,925, Danelski U.S. Pat. No. 9,241,529, Fleming et al. Published U.S. Application No. 20120167282, Rogers et al. British Patent No. 2,349,064 and WO2014025082.

One model of solar-powered fan, sold as a Kool Breeze hardhat, has a string of consecutive solar panels extending along the top ridge to that hardhat body proper. But such an arrangement is dangerous in that the string of panels CANNOT be covered with a fan protector like that of the present invention. Worse, the wearer of such a hat is vulnerable to injury (as well as damage to the fan-powering panels) by leaving them exposed to the sun from above—a must for such a solar powered arrangement. Such a system cannot accommodate a fan cover over the solar panels, the fan or any intentional gaps cut into, or pre-formed into the top of the hardhat body proper.

While the above-described devices fulfill their respective, particular objectives and requirements, the aforementioned patents and published application do not describe an air-conditioned hardhat that allows cooling the wearer's head from above while still protecting the top-of-the-hat positioned fan AND the wearer's head. Therefore, a need exists for a new and improved air-conditioned hardhat that can be used for cooling the wearer's head while still protecting the cooling fan and the wearer's head beneath this upper fan. In this regard, the present invention substantially fulfills said need. The air-conditioned hardhat described herein departs from the conventional concepts and designs of the known prior art.

BRIEF SUMMARY OF THE INVENTION

In view of the foregoing disadvantages of the known art, the present invention provides an improved air-conditioned hardhat that overcomes their drawbacks. This invention will provide a new and improved hardhat that protects its top mounted head fan yet still covers that fan to protect it from overhead damage while at the same time protecting the hardhat wearer from potential injury from above.

To attain this, the invention comprises a hardhat with a top mounted fan, a permanently attached fan-covering component and an external, rechargeable power supply. A wire connects this power supply to the fan's motor that is mounted for rotating downwardly from the top of the main hat component above its wearer's head. The power supply may be selected from the group consisting of a fuel cell, solar cell, multiple batteries and, most preferably, an externally connectible, rechargeable battery. Alternately, power may be provided from a rechargeable pack that gets removed from its holder for periodic recharging as needed. A first switch wire connects that fan motor to the power supply. That switch may be a rocker or pushbutton on/off switch.

The fan may be made of plastic, steel, aluminum, titanium, or carbon fiber composite. The main hat component may be made from hard plastic or a composite. The same for the fan cover protective component. To a lesser degree, one or more sections of the hardhat body proper, AND its fan cover component, may be made from, or at least partially, structurally reinforced by metals like aluminum and/or steel.

For mounting the fan cover to the hardhat, over a top aperture fan access, either the fan cover, the hardhat body or both will include a plurality of raised ridges or weldable points. Preferably, at least 3 such ridges, ideally four or more, protrude inwardly (and downwardly) about a half inch or so from an inner surface of the fan cover. They serve as means for permanently connecting the cover OVER the fan installed in an aperture in the top of the hardhat body proper.

The invention comprises an improvement to a hardhat. There are, of course, additional features of the invention that will be described and which will form the subject matter of the claims.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying photographs. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air-conditioned hardhat that has all of the advantages of the known prior art headgear yet none of their disadvantages.

It is another object of the present invention to provide a new and improved air-conditioned hardhat that may be easily and efficiently manufactured and marketed.

An even further object of the present invention is to provide a new and improved air-conditioned hardhat that has a low cost of manufacture with regard to both materials and labor, and which accordingly is then susceptible of low prices of sale to the consuming public, thereby making such air-conditioned hardhats economically available to the buying public.

Still another object of the present invention is to provide a new air-conditioned hardhat that provides in the apparatuses and methods of the prior art some of the advantages thereof, while simultaneously overcoming some of the disadvantages normally associated therewith. Even still another object of the present invention is to provide an air-conditioned hardhat for cooling the wearer's head from above. This allows a battery charger to connect to an electrical outlet for charging the rechargeable battery.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying photographs and descriptive matter in which there is illustrated current embodiments of the invention.

BRIEF DESCRIPTION OF THE SEVERAL VIEWS OF DRAWINGS

The invention will be better understood and objects/advantages made more apparent when consideration is given to the following detailed description that makes reference to the accompanying drawings in which.

DETAILED DESCRIPTION OF PREFERRED EMBODIMENTS

Figure 1:
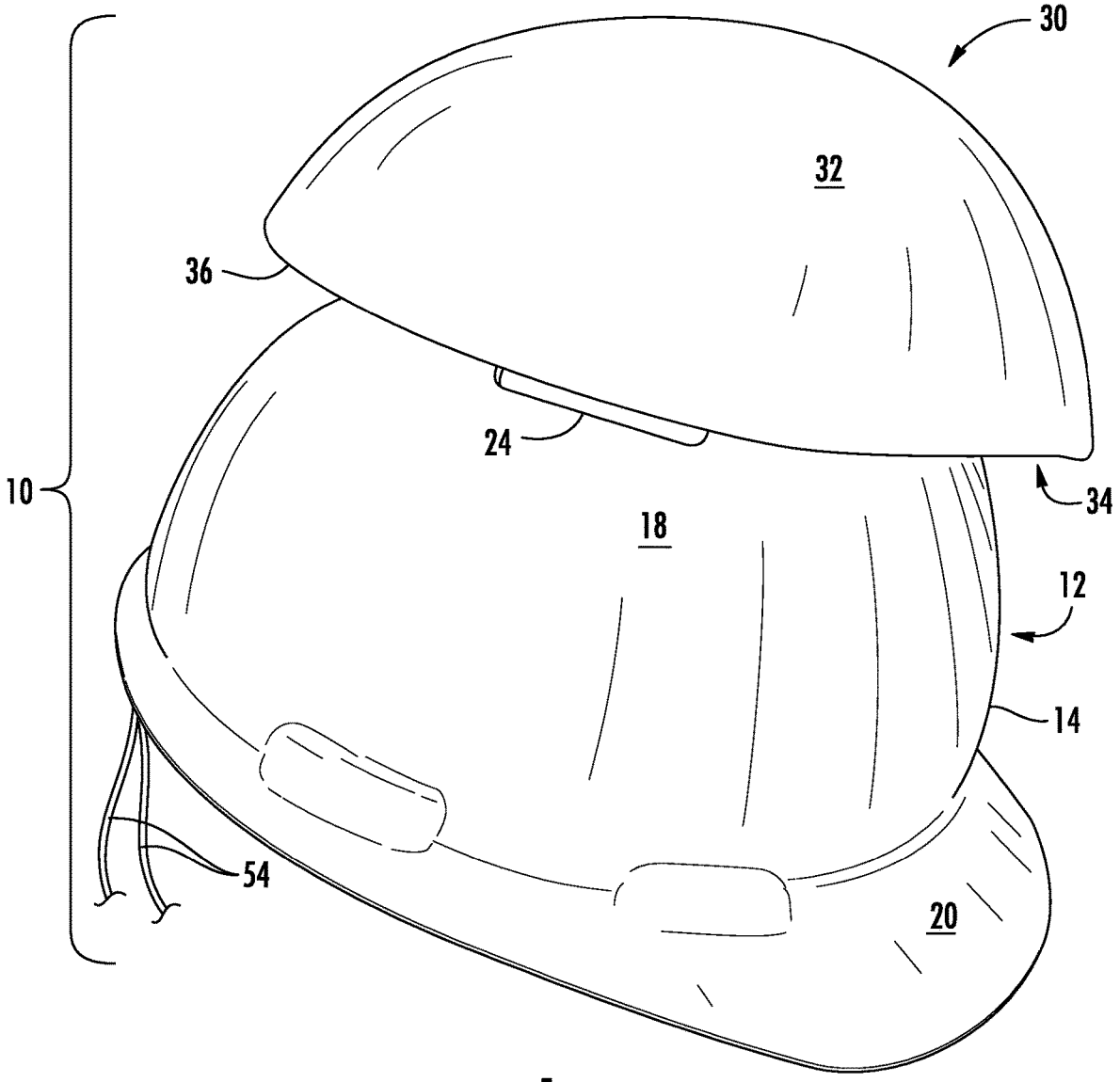
FIG. 1 is a side perspective view of the fan cover component suspended over the fan and air-conditioned hardhat component, said cover component designed to be eventually permanently joined (i.e., by ultrasonic welding) at a plurality of ridge welding connecting points.
Figure 2:
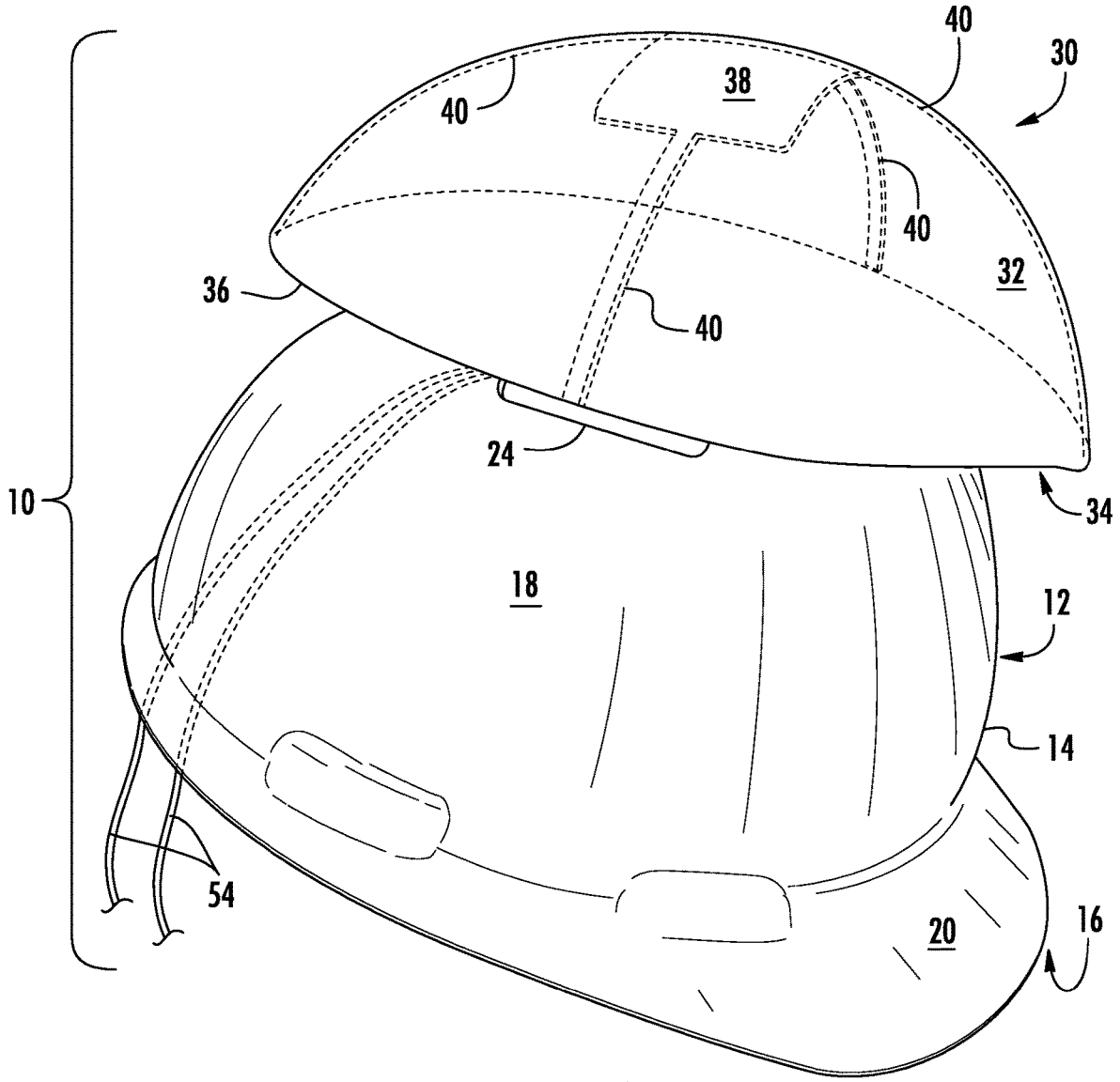
FIG. 2 is a partial sectional view of the fan cover component and hardhat component from FIG. 1, with one version of welding ridges shown by dotted lines in the fan cover component and a set of representative fan wires shown by dotted lines in the hardhat component interior.
Figure 3:
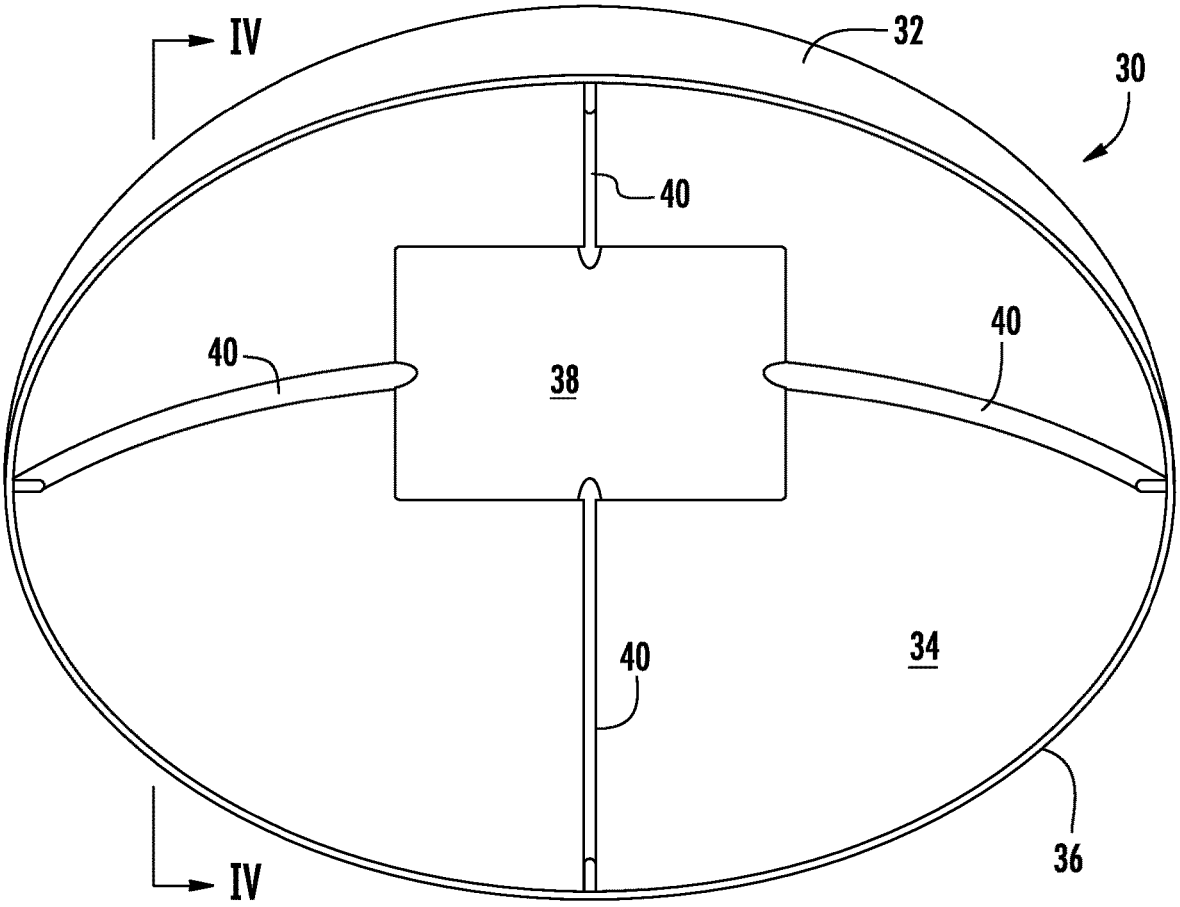
FIG. 3 is a top perspective view of the interior to one version of fan cover component per this invention.
Figure 4:
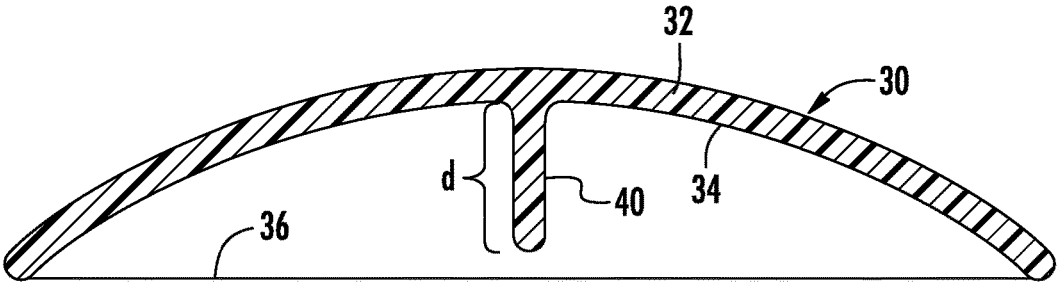
FIG. 4 is a sectional view taken along lines IV-IV of FIG. 3.
Figure 5:
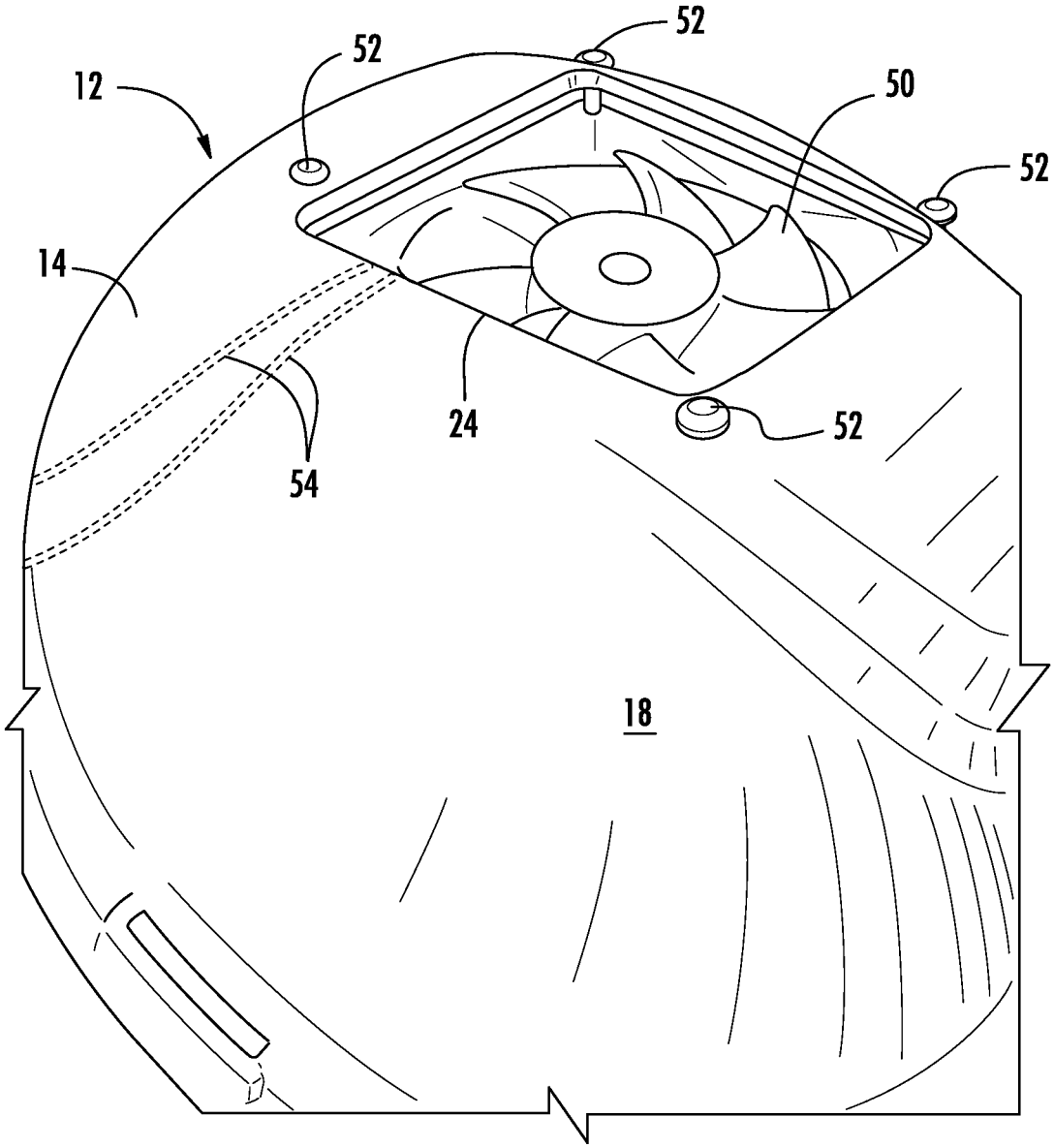
FIG. 5 is a top perspective view showing the fan installed into an aperture in the top of the hardhat component (wires from that fan being shown with dotted lines)
Figure 6:
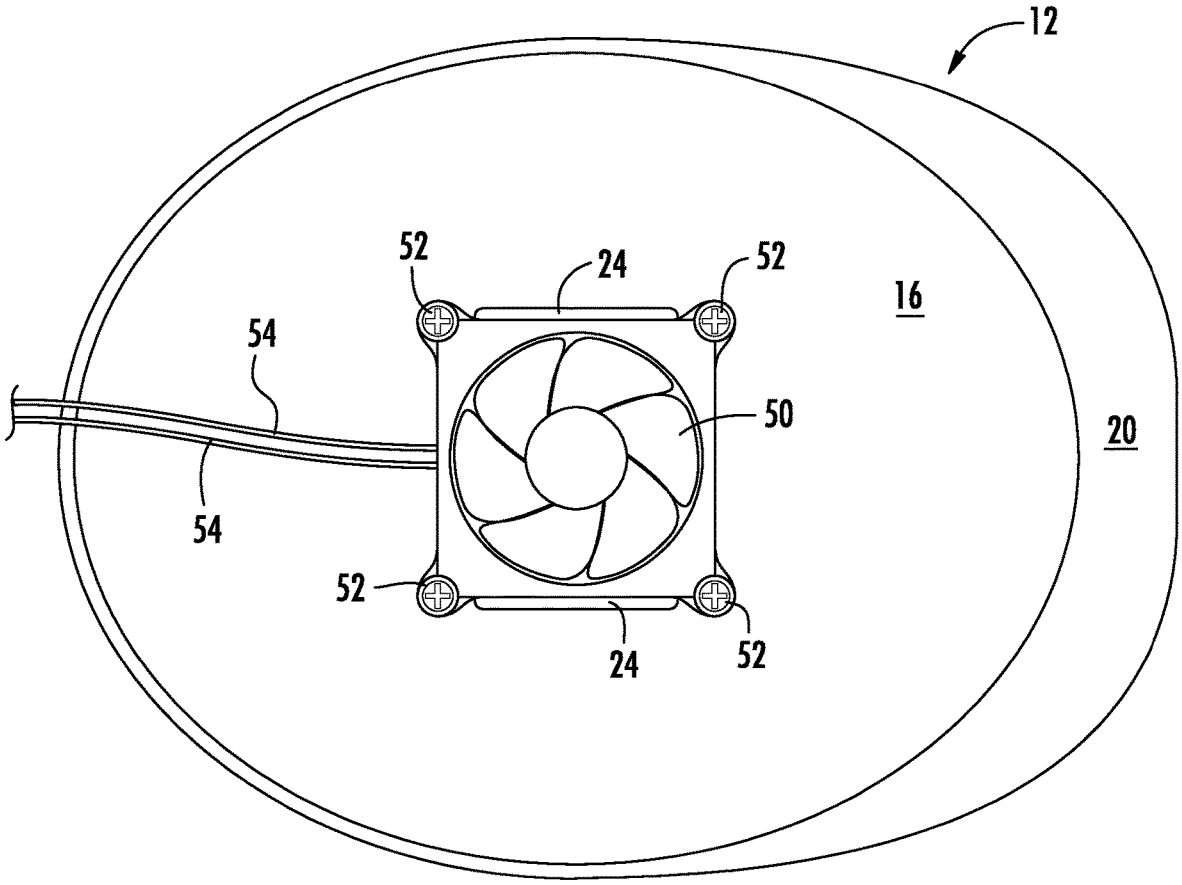
FIG. 6 is a top plan view into the interior of the hardhat component showing the screw mounts of the fan over the aperture area in said hardhat component.
Figure 7:
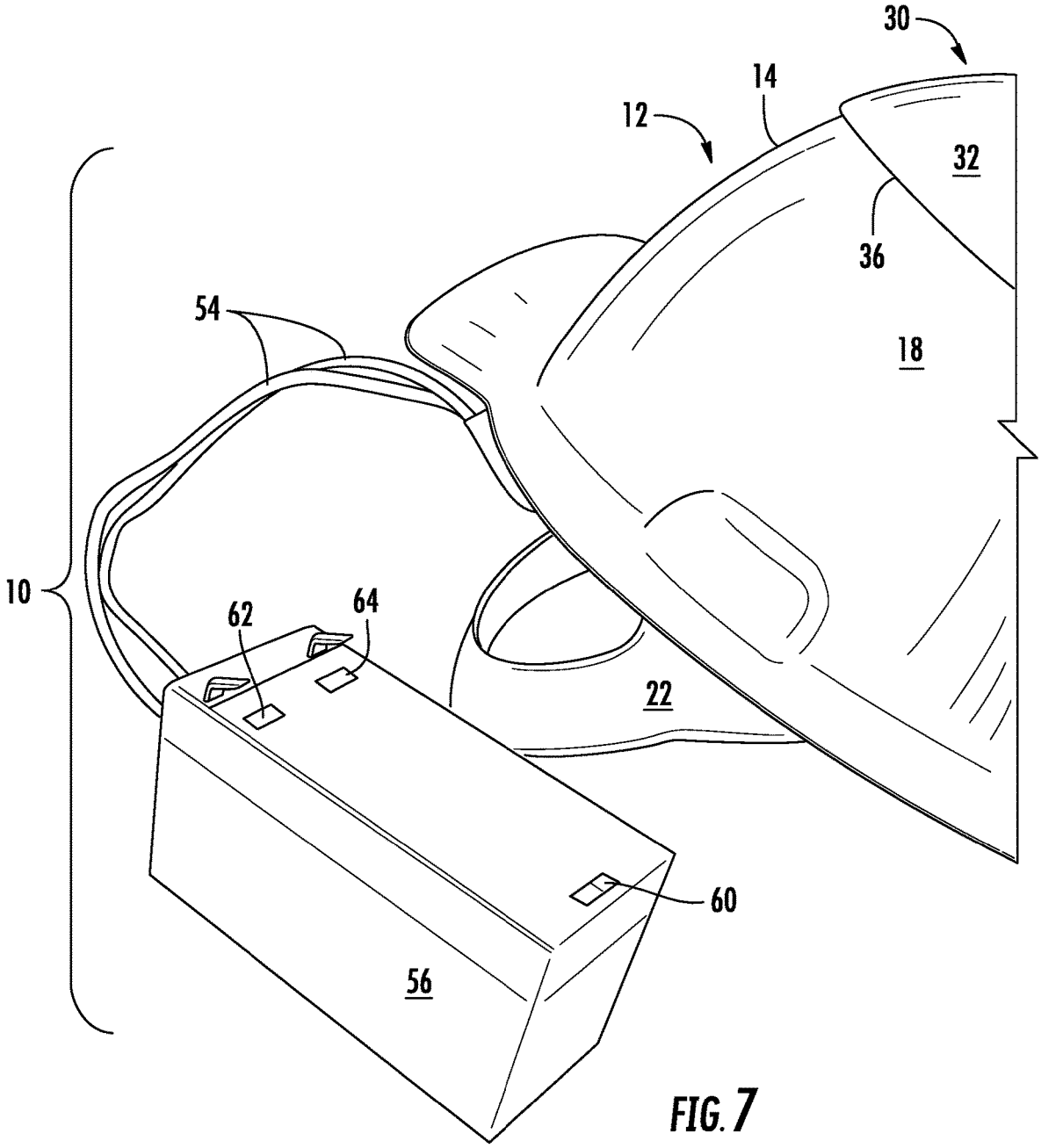
FIG. 7 is a rear perspective view showing a back area of the hardhat component, its rear head strap and the fan wires connecting to a battery power pack.
Figure 8:
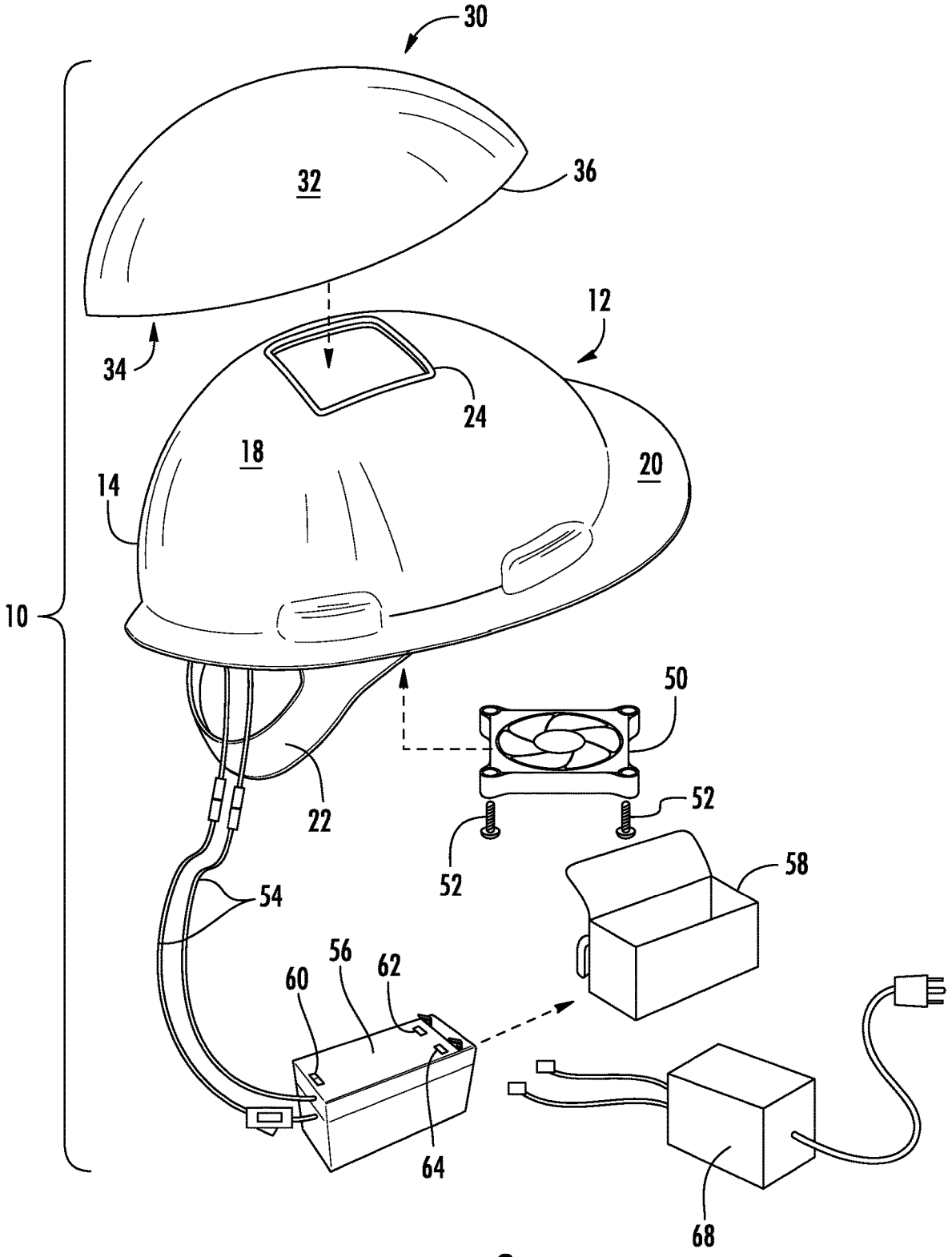
FIG. 8 is an exploded side perspective view showing the various component parts before assembly into one preferred embodiment of this invention.

Referring now to the drawings, one embodiment of improved air-conditioned hardhat assembly, generally item 10, is shown. That structural assembly comprises a main hardhat body component 12 with an exterior 14 and an interior 16, said main body component typically including an upper domed region 18. Often, such main body components further include a front eyeshade or finger-grip 20 and an adjustable internal rear head strap 22.

For this invention, there is provided an aperture 24 that is either made integral with the manufacture of main body component 12, or manually cut (lasered/machined or the like) into and through upper domed region 18 after hardhat manufacture. This aperture 24 serves as the means for drawing outside air under the fan cover component 30 and downwardly towards the electrically powered fan 50 above the helmet wearer's head.

As for the fan cover component 30, it is substantially bowl or dome-shaped with an outer dome surface 32 and a curved inner "shell" surface 34. Fan cover component 30 has a lowermost circumference/perimeter 36 that is mostly oval shaped. In one embodiment of this invention, fan cover component somewhat resembles an elongated yarmulke.

Ideally, fan cover component 30 is made from the same material as the main hardhat body component 12 though it is to be understood that other fan cover component materials may also be paired up with different underlying main hardhat body component materials. For example, a metal-based fan cover component can be made to permanently affix to a polymer-based main hardhat component . . . and vice versa.

In a first embodiment, the curved inner shell surface 34 of fan cover component 30 is fitted with a plurality of protuberances or raised blips, pimples, ridges or the like. They serve as: (a) spacers for keeping the fan cover component a set gap distance "d" above/over the upper most exterior 14 of the main hardhat component 12, particularly over fan region/aperture 24; and as (b) joinder connecting points—or areas where the manufacturing process permanently joins fan cover component 30 to main hardhat component 12. For this first embodiment, the plurality of protuberances/ridges 40 are substantially linear and extend from a central most region 38 of curved inner shell surface 34 in both a north-to-south AND east-to-west manner . . . somewhat like ridges extending along the 12 o'clock, 3 o'clock, 6 o'clock and 9 o'clock points of a clock face.

The fan cover component 30 will not contact the main hardhat body 12 along all edges. Rather, it is meant to be purposefully gapped a preferred set distance d above. In one version, fan cover component 30 is raised or extended about ½ in. above main hardhat body 12 for allowing for vented airflow into the helmet's fan. Alternately, spaced gaps of about ¼ to ¾ in are anticipated hereby. This fan cover component extends from front to rear of the hardhat. It may also protrude slightly down from either end so as to resemble a three-dimensional oval. Alternately, fan cover component 30 may extend from side to side of the hardhat.

Preferably, the fan cover component 30 gets ultrasonically welded to main hardhat body component 12 at at least a majority of these plurality of protuberances/ridges 40. For lesser manufacturing costs (and especially for use in less wear-and-tear, safety conditions), it is possible for the fan cover component 30 to be permanently adhered with glue or another adhesive to these same plurality of protuberances/ridges 40.

In a first alternative, a plurality of protuberances/ridges may extend along uppermost outer ridges to the exterior 14 of main hardhat body component 12 either in place of, or in addition to, the plurality of protuberances/ridges 40 on the curved inner shell surface 34 of fan cover component 30.

An electric fan 50 mounts internally with screws 52 as shown to an interior 16 of main hardhat body 12 of the invention 10. Most preferably, fan 50 covers a majority of aperture 24. It connects via wires 54 to an external power source, preferably a rechargeable battery 56 in its belt worn battery case 58. Fan 50 would have at least one on-off switch 60 that is easily accessible. In still other versions, fan 50 may be activated via a phone app (not shown). Still other versions may include a variable speed switch 62, or reverse motor switch 64.

One rechargeable battery 56 provides 12 volts of energy and 1.3 amps to the fan 50. As configured, such a rechargeable arrangement could hold enough energy for about 12-14 hours of continuous use and be fully recharged after only about 2.5-3 hours (or overnight). An alternate arrangement would allow for the hardhat wearer to keep a "hard-wired" battery pack clip/case 58 on a side or rear of the hardhat wearer's belt (rather than on the hat exterior where it is more susceptible to damage and/or faster drainage due to exposure to the elements). Such a clip configuration 58 could be designed to hold multiple hard-wired batteries, in series or in parallel, or a single pack that can be recharged overnight from an exterior powering station 68. In still other instances, the overhead cooling fan of this invention can be coupled to the light source (and switch) for a front-powered headlight, on some models of hardhat requiring occasional supplemental lighting uses.

While a current embodiment of the air-conditioned hardhat has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable lightweight material such as steel, aluminum, titanium, or carbon fiber composite may be used instead of the plastic fan described. And although cooling the wearer's head has been described, it should be appreciated that the air-conditioned hardhat herein described could also be adapted for use as a firefighter's helmet, an Army helmet, or sports team (i.e., football) helmet. Furthermore, a wide variety of power supplies may be used instead of the preferred rechargeable battery arrangement described above.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Having described the best modes currently known for practicing this axle replacement system and method, it is to be understood that the scope of this invention may be further described by the attached claims.

SEQUENCE LISTING

Not applicable.

What is claimed is:

1. An air-conditioned hardhat that comprises:
   - a main hardhat body component having an upper aperture through which air is drawn and pulled down into an electric fan mounted from an interior of the main hardhat body component;
   - a fan cover component spaced from a top exterior of the main hardhat body component over the electric fan;
   - a plurality of protuberances for spacing the fan cover component a set gap distance from the top exterior of the main hardhat body component, said protuberances extend downwardly from the interior of the fan cover component and extend radially from a central most region of the interior of the fan cover component along the top exterior of the main hardhat body component;
   - a battery pack for powering the electric fan; and
   - a plurality of wires for connecting the electric fan in the main hardhat body component to the battery pack.

2. The hardhat of claim 1 wherein at least four separate protuberances extend downwardly from an interior of the fan cover component.

3. The hardhat of claim 1 wherein the plurality of protuberances extend substantially linearly to create a plurality of ridge-like connectors between the fan cover component and the main hardhat body component.

4. The hardhat of claim 3 wherein the plurality of ridge-like connectors extend from front to rear of the interior of the fan cover component.

5. The hardhat of claim 3 wherein the plurality of ridge-like connectors extend from side to side of the interior of the fan cover component.

6. The hardhat of claim 3 wherein the plurality of ridge-like connectors extend from a center region of the interior of the fan cover component to an outermost edge of the interior of the fan cover component at equivalents to at least 3 o'clock and 6 o'clock about the center region.

7. The hardhat of claim 3 wherein the plurality of ridge-like connectors are adapted for permanently adhering the fan cover component to the top exterior of the main hardhat body component.

8. The hardhat of claim 7 wherein the plurality of ridge-like connectors are adapted for ultrasonically welding the fan cover component to the top exterior of the main hardhat body component.

9. The hardhat of claim 1 wherein the set gap distance is at least about ¼ inch.

10. The hardhat of claim 9 wherein the set gap distance is about ½ inch.

11. The hardhat of claim 1, which further includes at least one fan on/off switch.

12. The hardhat of claim 11 wherein said at least one fan on/off switch can be activated via a phone app.

13. The hardhat of claim 1 wherein the fan cover component is made from a material selected from the group consisting of plastic, steel, aluminum, titanium, and carbon fiber composite.

14. A hardhat with a protected overhead cooling fan, said hardhat comprising:

a main hardhat body component having an upper aperture through which air is drawn and pulled down into a battery powered cooling fan mounted from an interior of the main hardhat body component;

a fan cover component spaced from and permanently adhered to a top exterior of the main hardhat body component over the electric fan;

a plurality of linear ridges for spacing the fan cover component at least about % inch from the top exterior of the main hardhat body component, each of said plurality of linear ridges extending downwardly from the interior of the fan cover component and extending radially from a central most region of the interior of the fan cover component along the top exterior of the main hardhat body component;

a battery pack for powering the cooling fan; and a plurality of wires for connecting the cooling fan in the main hardhat body component to the battery pack.

15. The hardhat of claim 14 wherein at least four linear ridges extend downwardly from an interior of the fan cover component.

16. The hardhat of claim 14 wherein the plurality of linear ridges are adapted for ultrasonically welding the fan cover component the top exterior of the main hardhat body component.

17. The hardhat of claim 14 wherein the plurality of linear ridges keep the fan cover component spaced at least about ½ inch from the top exterior of the main hardhat body component.

18. The hardhat of claim 14 wherein fan cover component is made from a material selected from the group consisting of plastic, steel, aluminum, titanium, and carbon fiber composite.

19. A method for providing a hardhat wearer with a protected, battery powered overhead cooling fan, said method comprising the steps of:

(a) supplying a main hardhat component with an upper aperture through which air can be drawn from above and pulled down into a battery powered cooling fan having an on-off switch and mounted to an interior of the main hardhat body component;

(b) providing a fan cover component, said fan cover component having a plurality of linear ridges for spacing said fan cover component at least about ¼ inch from and permanently adhering the fan cover component to a top exterior of the main hardhat body component at least directly over the cooling fan;

(c) supplying a rechargeable battery pack with connecting wires to power the cooling fan; and (d) powering the battery pack so that the hardhat wearer may turn the protected cooling fan on and off as needed.

20. The method of claim 19, which further includes:

(e) providing a phone app so that the hardhat wearer may turn the cooling fan on and off remotely.

* * * * *